US005413175A

United States Patent [19]

Edmunds

[11] Patent Number: 5,413,175

[45] Date of Patent: May 9, 1995

[54] STABILIZATION AND CONTROL OF HOT TWO PHASE FLOW IN A WELL

[75] Inventor: Neil Edmunds, Calgary, Canada

[73] Assignee: Alberta Oil Sands Technology and Research Authority, Edmonton, Canada

[21] Appl. No.: 227,116

[22] Filed: Apr. 13, 1994

[30] Foreign Application Priority Data

May 26, 1993 [CA] Canada ..... 2096999

[51] Int. Cl.[6] ..... E21B 43/24; E21B 43/12; E21B 47/06

[52] U.S. Cl. ..... 166/252; 166/50; 166/53; 166/64; 166/272; 166/370; 73/155

[58] Field of Search ..... 166/303, 252, 250, 369, 166/370, 371, 372, 50, 53, 64, 272; 73/155

[56] References Cited

U.S. PATENT DOCUMENTS

| | | | |
|---|---|---|---|
| 4,228,855 | 10/1980 | Sustek, Jr. et al. | 166/250 |
| 4,344,485 | 8/1982 | Butler | 166/272 X |
| 5,046,559 | 9/1991 | Glandt | 166/272 X |
| 5,094,103 | 3/1992 | Wicks, III et al. | 166/250 X |
| 5,148,869 | 9/1992 | Sanchez | 166/50 X |
| 5,215,146 | 6/1993 | Sanchez | 166/272 X |
| 5,273,111 | 12/1993 | Brannan et al. | 166/272 X |
| 5,318,124 | 6/1994 | Ong et al. | 166/272 X |

*Primary Examiner*—Stephen J. Novosad
*Attorney, Agent, or Firm*—Rothgerber, Appel, Powers & Johnson

[57] ABSTRACT

A method is provided for the stabilization and control of the two-phase flow of hot fluid containing water issuing from the top of an upwardly rising conduit or riser of a horizontal oil-production well. The fluid enters the bottom of the riser at a temperature higher than the saturation temperature of water at the conditions prevailing at the top of the riser. A first mass rate flow controller is coupled to a mass rate flow detector at the top of the well for controlling mass flow at a substantially constant rate over a short time interval. Signals indicative of the optimal flow rate for the process are input to a second controller. The second controller adjusts the mass flow rate setpoint of the first controller. The second controller has a time constant significantly longer than that of the first controller. Thus, the mass rate of hot fluid is controlled at a substantially constant mass rate over the short term, thereby stabilizing two-phase flow, and is adjusted over the longer term to control the flow of fluid at an optimal rate.

3 Claims, 4 Drawing Sheets

Numerical Geyser Model

Flow Rate During Geysering

Wellhead total mass rate (tonnes/D+1)
10,000
1,000
100
10
1
0
5
10
15
20
25
30
35
40
45
Minutes after start of flow Steam Saturation vs. Time and Depth Depth (m)
15
35
55
75
95
115
135
155
175
195
16.5
18
20
22
24
26
28
30
32
34
36
38
Minutes after start of flow

STABILIZATION AND CONTROL OF HOT TWO PHASE FLOW IN A WELL

FIELD OF THE INVENTION

This invention relates to a method for the stabilization and control of the flow of two-phase hot fluid containing water, flowing upwardly through a rising conduit and, more particularly, for the stabilization and control of hot oil, which contains water and steam, produced at ground surface from an underground Steam Assisted Gravity Drainage (SAGD) operation.

BACKGROUND OF THE INVENTION

The use of the Steam Assisted Gravity Drainage (SAGD) technique using pairs of parallel steam injection and oil production wells has resulted in the production of very hot fluid rising at high flow rates through the upwardly extending riser portion of the production wellbore to the surface. Saturation conditions are encountered in the riser, resulting in behavior analogous to gas lifting (steam lift). Due to the large release of energy of flashing water, however, the flow in the riser is unstable. These instabilities are the same phenomenon that drive cyclic eruptions in geothermal geysers.

When flowing a conventional vertical well produced with a steam drive, the fluid rate is relatively low (typically 10 $m^3$/d.)Heat is given up through the wellbore to the surrounding formation, cooling the produced fluid and avoiding flashing.

Commercial implementation of the SAGD technology can produce fluid rates of 300 $m^3$/d and upwards to levels in excess of 1000 $m^3$/d. At these high rates, the fluid does not cool significantly en route to the surface.

SAGD uses a horizontal production well located in a viscous oil reservoir, producing heated oil which gravity drains from a steam chamber located around a steam injection well above and closely parallel and co-extensive to the production well. SAGD is in development at the AOSTRA Underground Test Facility (UTF) located in Northern Alberta, Canada. The SAGD is described in various publications by R. M. Butler et al., U.S. Pat. No. 4,344,485 issued to Butler, and Canadian patent 1,304,287 issued to applicant.

As the fluid flows up the riser portion of the well, the hydrostatic head on the fluid diminishes (there being less fluid above to compress the fluid below) and the pressure drops. When the pressure of the fluid reaches the saturation pressure of water, then contained water flashes to steam. At higher fluid temperatures, the fluid pressure may only reduce a small amount before the saturation pressure is reached and flashing occurs.

When water contained in the well flashes to steam then tremendous energy is released. At downhole pressures of 1700 kPa (absolute), the volume that the produced steam displaces is over 100 times the volume of water from which it was formed. The saturation temperature of steam at 1700 kPa is about 200° C. Steam can increase its volume over 1600 times at atmospheric pressures and 100° C. The large expanding volume of the generated steam results in a violent attempt to expel the fluid which is above the location of the flash.

With a constant pressure wellhead, the fluid is released in a surge. Further, the removal of the initial fluid releases the hydrostatic back-pressure on the remaining fluid resulting in a progressive "flash front" which propagates successively downwards in the riser, ejecting the remaining hot fluid. When the energy of the high velocity steam flow eventually diminishes, the riser refills. Once the riser refills, the flow of hot fluid resumes, re-initiating a cyclical periodic repeating of this geyser-like behavior.

The instability associated with periodic geyser behavior is destructive to achieving steady and efficient production.

In conventional oil-production applications, when a downhole pump is used, backpressure can be maintained at the wellhead, preventing the saturation pressure from ever being reached. However, in the SAGD situation the flow rates are so high that pumping is expensive and difficult. The largest downhole pumps are capable of pumping only about 750 $m^3$/d and temperatures are prohibitively high for the sealing components at 200° to 300° C. Therefore, the use of formation pressure or steam lifting is an attractive alternative to pumping if the flashing can be controlled.

Conventional attempts to control the steam-lifted flow with manual adjustments of a production choke at the wellhead results in the initiation of a strong positive feedback action-response cycle. This cycle results during both an attempted increase and a reduction in the flow.

As the choke flow is manually reduced, the bottom hole pressure increases, which in turn further reduces the flow rate from the reservoir. Dependent upon the characteristics of the reservoir, several outcomes are predictable:

- if the reservoir pressure is below the hydrostatic head of the column of liquid in the riser, then the well will die; or
- if the reservoir pressure is greater than the hydrostatic head then the well exhibits cycling geyser behavior.

If the flow rate from the well is manually increased, the bottom hole pressure decreases, causing a further increase in the flow. If the positive feedback cycle is not interrupted then the well can overdraw the reservoir and produce massive volumes of driving steam.

It is an object of the present invention to provide a method for controlling the well to stabilize the flow of hot fluid up the riser, avoiding the cyclic instabilities described hereinabove.

SUMMARY OF THE INVENTION

The invention relates to a method for stabilizing and controlling the two-phase flow of hot fluid containing water issuing from an upwardly rising conduit. The fluid enters the bottom of the well at a temperature higher than the saturation temperature of water at the conditions prevailing at the top of the conduit. The mass rate of flow of hot fluid from the top of the conduit is controlled at a substantially constant rate over a short time interval to stabilize the cyclic and unstable behaviour of water flashing in the conduit, and is varied over a large time interval to control the flow of fluid at an optimal rate.

The invention comprises:

- a fluid production choke means located at the top of the conduit for adjusting the mass flow rate of the hot fluid issuing therefrom;
- a mass flow detection means downstream of the production choke means for repetitively producing signals indicative of the mass flow rate of hot fluid flowing therethrough;

a first mass rate control means, associated with the mass flow detection means and the production choke means, for controlling the mass rate of fluid through the choke;

measurement means for repetitively producing process signals related to optimal production of the fluid; and a second controlling means for receiving the process signals and being cascaded to the first controlling means for modifying the output of the first controlling means when process signals indicate that the mass rate requires adjustment to achieve optimal production of fluid;

whereby:

the hot fluid is produced at a substantially constant mass rate over a short time interval using the first mass rate controller and production choke means, whereby two-phase flow is stabilized; and the mass rate of flow of the hot fluid is adjusted in response to the process signals, over a time interval which is large relative to the short time interval of the first mass rate controller whereby the mass rate of fluid flow may be controlled at an optimal level.

DETAILED DESCRIPTION OF THE PREFERRED EMBODIMENT

Figure 1:
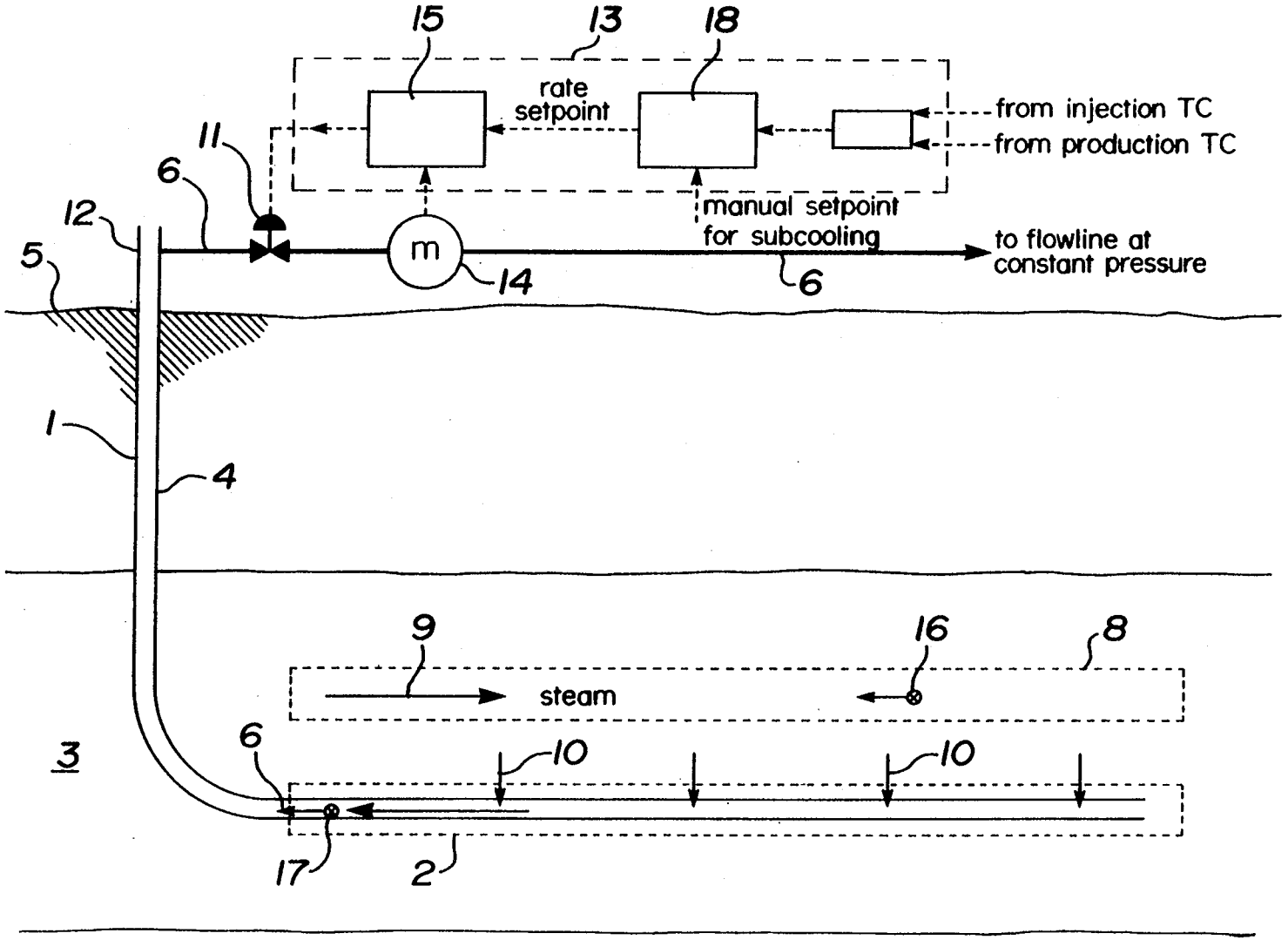
FIG. 1 is a schematic cross sectional view of the apparatus of the cascaded control system coupled with a SAGD production well.

Referring to FIG. 1, a horizontal production well 1 peculiar to a surface access SAGD well is shown which is equipped with apparatus for practicing the method of the present invention. The horizontal well 1 is comprised of a production liner 2 extending horizontally through the reservoir 3 and a production riser portion 4 curving and rising upwardly therefrom to the surface 5. The riser 4 is a tubular conduit adapted to carry produced fluid 6 from the reservoir 3, upwardly to the surface 5.

The horizontal portion of a steam injection well and injection liner 8 is shown located above and parallel to the production liner 2. Steam 9 is injected from the injection liner 8 to heat the viscous oil of the reservoir 3, permitting gravity draining of heated oil to occur. As described in detail in U.S. Pat. No. 4,344,485 to Butler, a steam chamber (not shown) is formed, encouraging heated fluid 10, comprising oil and water, to gravity drain and be collected in the production liner 2.

The heated fluid 10 is carried up the riser 5 to the surface. The flow rate of the fluid 10 is controlled through a production choke valve 11 located at the wellhead 12.

A cascade control system 13 is provided, responding to the flow rate of the produced fluid 6 and on process temperatures optimal to efficient recovery from the SAGD system. In this way, major short term flow rate disturbances relating to geyser behavior can be minimized and filtered from the longer term process control considerations.

A metering means 14 monitors the production flow rate of produced fluids 6 through the choke 11 and produces signals indicative of the mass rate of flow. A first mass rate flow controller 15 uses, as its input, the mass flow rate signal from the metering means 14. The mass rate controller 15 compares the measured value of the mass flow rate with its setpoint and adjusts the choke valve 11 to align the measured flow rate with the desired rate.

In the short term, usually measured in minutes, the mass rate controller 15 acts to control the mass rate of flow at a substantially constant rate despite flow instabilities that may occur in the well. When a flash occurs, the liquid above the flash, which would previously have been ejected, is restrained by the production choke. Thus the pressure profile in the riser below the flash is maintained, and a progressive flash to the bottom of the riser is averted. Pressure at the bottom of the riser remains substantially constant and cyclic geyser behavior is prevented.

In the longer term however, it is recognised that the mass rate of flow must be controlled to meet the efficient recovery objectives of the overall process.

In a SAGD well implementation, it is useful to maintain the production liner temperature at a specific level to optimize the production of oil. If the production rate is too high, the temperature at the production liner 2 will increase, risking a breakthrough of the injection steam 9. If the production rate is too low, the temperature at the production liner will drop, permitting the formation of a pool of cool liquid in the steam chamber. This cool liquid can block the gravity flow path for heated reservoir oil to the production liner. Thus, adjustment of the production rate, or mass rate of liquid flow, can significantly affect the production liner temperature. Optimal production from the reservoir is generally achieved when the temperature of the production liner 2 is typically sub-cooled to 5° to 10° C. below the saturation temperature of water at the pressure of the injection liner 8.

Temperature measurement devices, such as thermocouples 16, 17, are located at the production liner 2 and at the injection liner 8 respectively. The signals are carried to the surface 5 and are compared. The temperature difference is supplied as process input to a second, steam trap controller 18. This second controller behaves in a manner analogous to a steam trap. The steam trap controller 18 acts upon the input, compares it to the desired optimal process sub-cooled temperature and outputs an appropriate mass flow rate setpoint signal to the mass rate controller 15. The change of the mass flow rate setpoint is only apparent over the long term. The thermal mass of the steam heated chamber of the SAGD and other thermal drive processes are large and response to process changes occurs over long periods, in the order of days or even weeks.

The placement of thermocouples at the bottom of wells is a conventional practise. Thermocouple devices have been shown to be reliable and accurate for long periods and are relatively inexpensive to run and operate. By contrast, it is rather difficult to accurately determine bottom hole pressures in thermal wells, and the present scheme deliberately avoids the need for downhole pressure measurement.

Figure 2:
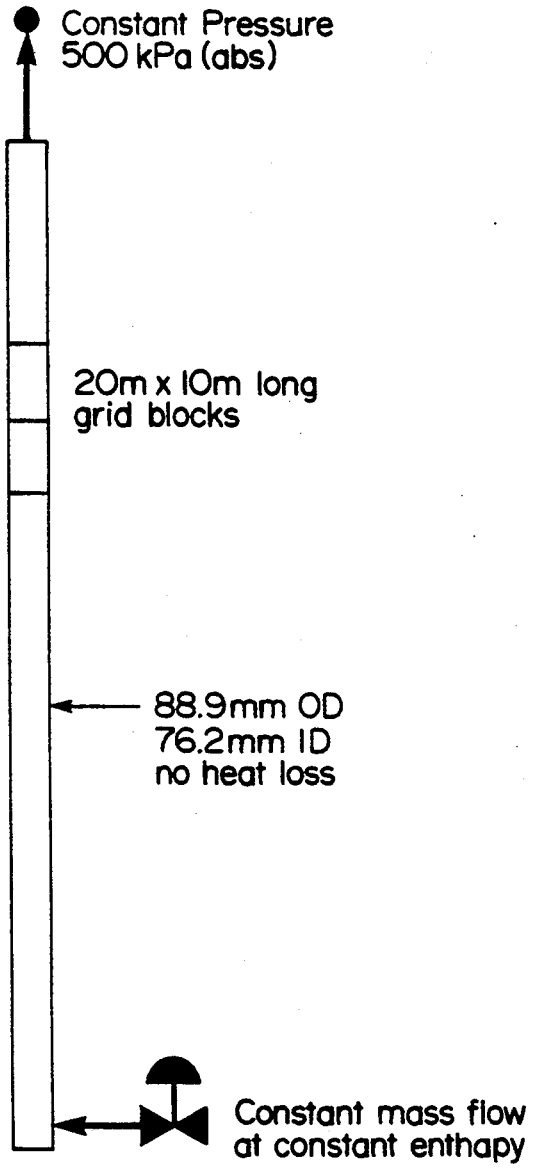
FIG. 2 is a model of a simple vertical conduit with constant wellhead pressure and constant bottom mass flow conditions.

The production choke 11 and mass flow meter 14 shown in FIG. 2 are however Simplifications of the required equipment. A standard production choke may be used with variable service life dependent upon the erosional effects of an expanding steam/water mixture. Due to the lack of a known single instrument available that could determine the combined mass flow rate of the liquid and steam, intermediate conditioning may be required. The overall stream could be separated and individually metered, summing the two measured values, or the entire stream could be condensed to form a single liquid phase for standard measurement.

In summary then, it is desirable to maintain the mass rate of flow from the well substantially constant in the short term, to stabilize the two-phase flow, and yet to vary it over a longer term to meet the overall production requirement.

Numerical model techniques were used to simulate the flow of hot fluid up the riser portion 4 of a well. A numerical model was formulated using a combination of the flow effects in long risers and their interaction with reservoir mechanics. The objective was to couple a multiphase, turbulent pipe flow model with a thermal reservoir simulator.

The pipe flow model resulted in a formulation that was transient in nature. The pipe, or riser was discretized into segments which correspond to reservoir grid blocks, and the usual balance and constraint equations were applied. Flux terms between blocks were calculated from phase velocities, which are carded as independent variables. A separate momentum equation is written for each phase, which describes the local acceleration of that phase due to the sum of gravity, pressure gradient, and shear forces. Shear forces may be reactions of the fluid against the pipe wall or against other phases, and were calculated as a function of the flow regime. The flow regime map is itself a simple function of in-situ phase volume fractions (saturations).

This type of formulation is sometimes called a drift flux model. When coupled with a thermal reservoir simulator, it proved to be robust, efficient, and extremely versatile. The formulation was combined with generalized reservoir simulation routines and the resulting program, called Gensim, was successfully used for the design of larger scale SAGD wells. The simulator is more fully described in the paper "A Comprehensive Wellbore/Reservoir Simulator", by Stone, Edmunds and Kristoff, SPE 18419, at the SPE Symposium on Reservoir Simulation in Houston, Tex. February 1989.

Two examples are presented, using the developed numerical simulation techniques to illustrate the wellhead behavior under different conditions. In a first example, conventional wellhead conditions are modelled to demonstrate the instabilities and control problems associated with geyser behavior. In a second example, the control method of the invention is shown to stabilize and control the reservoir production.

Example I

Referring to FIG. 2, a vertical length of riser was modelled. The riser comprised a 200 meter long, 88.9 mm OD, 76.2 mm ID tubing string which was ideally insulated on its outside. The modelling run was initiated assuming conditions after a one day shut-in situation. Thus, the riser was initially filled with cold water. The well was restarted with a constant mass rate of injection of hot water at the bottom of the riser and constant pressure at the wellhead.

Figure 3:
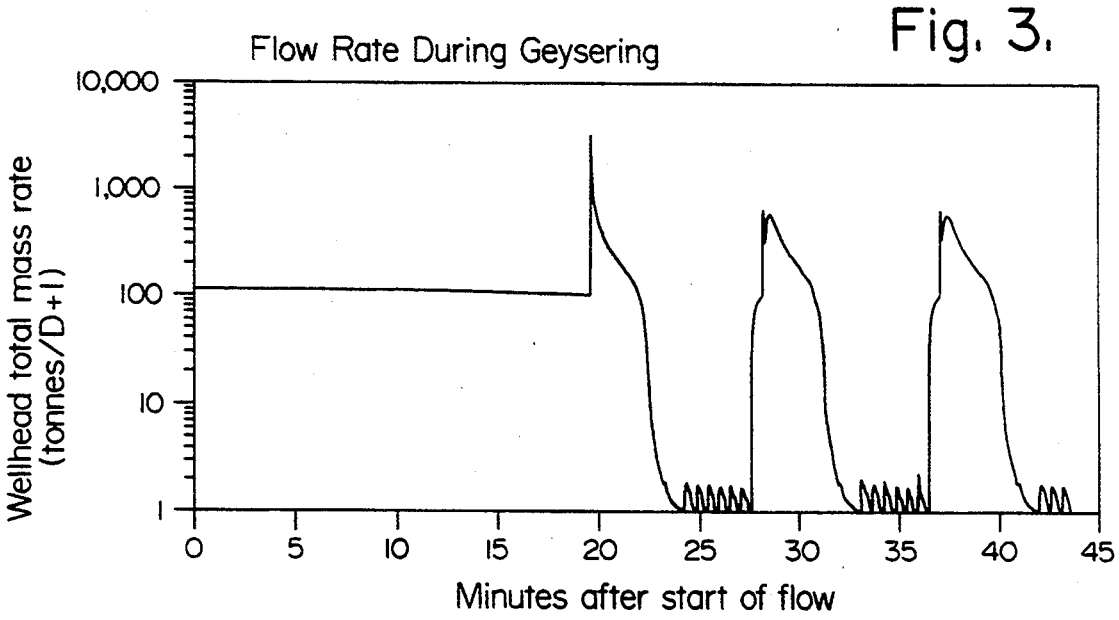
FIG. 3 is the result of a numerical simulation on the model according to FIG. 2.

As seen in FIG. 3, a mass rate of 100 $m^3/d$ was seen to flow steadily until about 20 minutes after the restart. Thereafter, the flow was seen to cycle between extreme peak and no-flow conditions. The cycling was determined to be related to the flashing of water in the uprising column of hot fluid in the riser.

Figure 4:
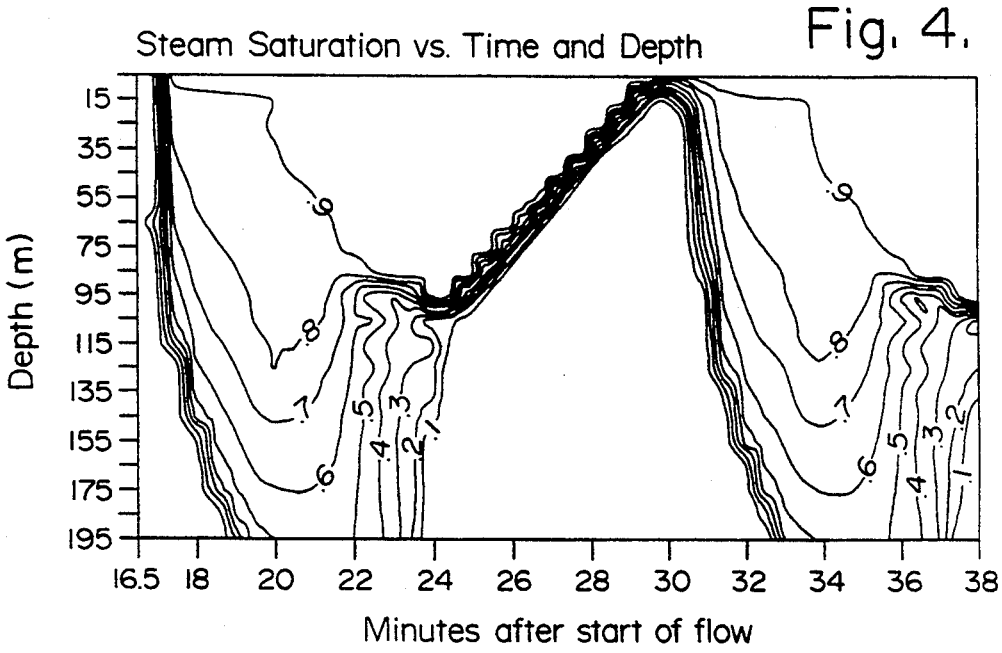
FIG. 4 is a steam fraction contour plot of the model results according to FIG. 2.

FIG. 4 presents a contour plot of the steam volume fraction of the fluid at any depth in the riser as time progresses left to right. A steam volume fraction of 0–0.1 indicates a fluid composition of almost 100% liquid water and 0.9–1.0 indicates nearly 100% steam. It may be seen that the appropriate temperature and pressure conditions for a flash were met at a depth of 65 meters and at 17 minutes. The flash front quickly propagates downward to the bottom of the well as the hydrostatic head of ejected fluid releases the restraining pressure on the remaining hot fluid. On FIG. 4, this is evidenced by the ever increasing steam fractions. At 19 minutes, the flash front reaches the bottom of the riser as shown by the transition to a 0.1–0.2 fractional steam contour. Geysering occurs throughout during this 2 minute period. When the energy of converting water to steam diminishes, vapor-suspended liquid starts to fall back down the riser at about 22 minutes. Additionally, new hot fluid is entering the bottom of the riser and is flashing upon entry. The vapor release is now limited by the incoming rate of liquid, not upon stored liquids with high potential energy. Therefore produced vapor velocities are not sufficient to cause geyser behavior and empty the refilling riser. The accumulating liquid causes a hydrostatic pressure increase in the bottom pressure, eventually suppressing the flashing. The column then reverts back to solely liquid (0–0.1 steam fraction) at 24 minutes. The column continues to refill, replenishing the column with hot fluid, and setting the stage for another cycle.

Figure 5:
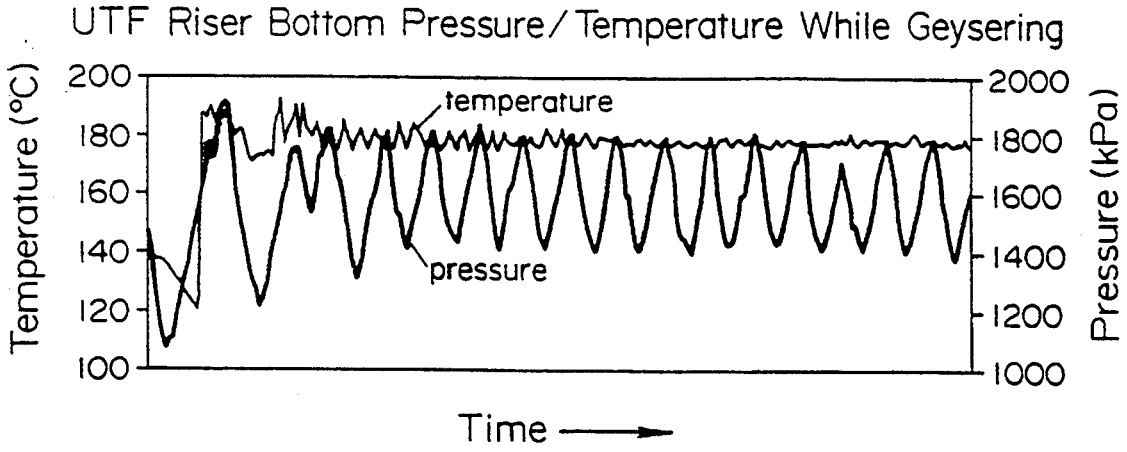
FIG. 5 is a plot of actual cyclic, unstable geyser behavior on a SAGD well.

Referring to FIG. 5, actual geysering behavior is exhibited in the actual recording of the riser bottom pressure in a UTF SAGD implementation, which compared well to a numerically simulated response.

Example II

In the second illustrative example, the complete reservoir, riser, and control system described above and illustrated in FIG. 1 was simulated as a single, fully coupled system.

As in the first example, a start-up of a production well that has been temporarily shut-in is modeled. The reservoir and riser were initialized so as to represent a SAGD well production liner and injection liner in the early to middle stage of depletion. A two-dimensional finite difference model grid was used to simulate one half of a symmetrical SAGD steam chamber 20 meters high and 10 meters wide by 500 meters long. The steam chamber was modelled to provide for the thermal mass and production response rate.

Full size reservoir parameters used in the simulation are summarized in Table 1.

TABLE 1

| | | |
|---|---|---|
| Reservoir Permeability | 5.0 | $(\mu m)^2$ |
| Reservoir Porosity | 35 | % |
| Steam Chamber Volume | 70000 | $m^3$ |
| Nominal Production Rates | 100 | t/d bitumen |
| | 200 | t/d Water |
| Heat Loss Rate to Over/Under | 6.05 | $kW/m^2$ |

TABLE 1-continued

| | | |
|---|---|---|
| burden | | |
| Production Liner Depth | 240 | m |
| Liner ID | 160 | mm |
| Liner OD | 180 | mm |
| Riser tubing OD | 76.7 | mm |
| Riser tubing ID | 100.0 | mm |
| Riser Kickoff Depth | 25 | m |
| Riser Curvature Radius | 215 | m |
| Liner and Riser Wall Mat'l | Carbon Steel | |
| Flowline Pressure | 1500 | kPa |
| Production Choke $C_v$ | 15 | |

Production riser conditions were set up as if the well had been shut-in for a period of about one day. The injection well pressure was set at 4000 kPa (absolute). This is also approximately the steam chamber and production liner pressure. Since the pressure at the bottom of the riser was greater than the hydrostatic pressure at a 240 m depth, the shut-in wellhead pressure was positive and the fluid level was at the surface. The riser above the liner was thus filled with cold water, but the water inside the liner itself was at the correct temperature for continuous production (the liner cools very slowly after a shutdown because of the proximity of the steam chamber).

The simulation results are summarized in FIG. 3 for a time period of 0.001 days (1.4 minutes) to 100 days after the beginning of flow. As only one half of the SAGD steam chamber was modelled, the reported mass rates of flow and mass rate controller setpoints are only one half of the full SAGD implementation.

The steam trap controller input error signal $\epsilon$ (which defines the desired controller output response) was set as a function of the difference of the injection and production liner temperatures, $T_i$ and $T_p$ and 5.0° C. of sub-cooling or $\epsilon = T_i - T_p - 5$.

The mass rate controller input error signal is a function of the output ($O_t$) of the steam trap controller and the measured fluid mass rate of flow ($\dot{m}_m$). A 3.5 scale factor is provided to modify the input error signal to represent a fractional opening of the production choke 9 resulting as:

$$\epsilon = \frac{O_t - \dot{m}_m}{3.5}$$

The controller constants were tuned as listed in Table 2.

TABLE 2

| | Mass Rate Control | | Steam Trap Control | |
|---|---|---|---|---|
| Constant | Value | Units | Value | Units |
| Offset | 0.25 | fraction | 1.0 | kg/s |
| Gain | 1.0 | s/kg | 0.02 | kg/s/°C. |
| Reset | 0.00005 | $kg^{-1}$ | 1.5e-6 | kg/°C./$s^2$ |
| Rate | 0.0 | $s^2$/kg | 4000.0 | kg/°C. |

The production choke was chosen with a $C_v$ of 15. The mass rate controller and production choke system was assumed to result in the $C_v$ varying linearly with the output of the mass rate controller.

Figure 6:
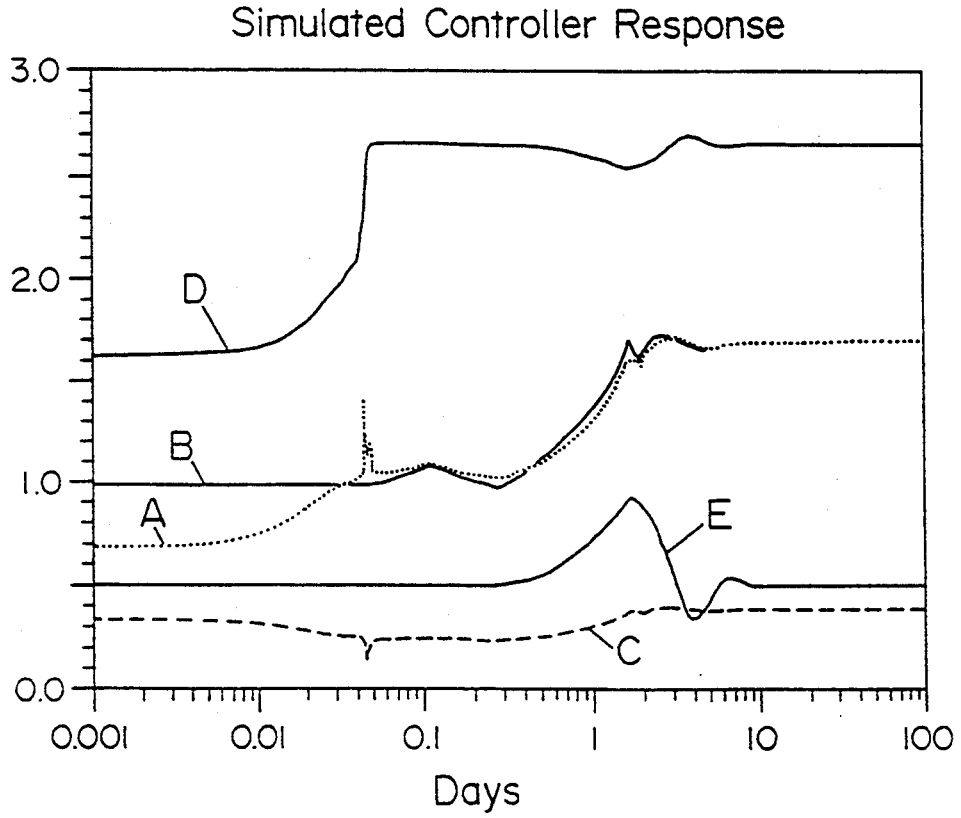
FIG. 6 is a plot of the numerically simulated results of the stabilized and controlled production riser and fluid behavior when implementing the method of the invention.

Referring to FIG. 6, the initial (half-model) wellhead flow rate A is about 0.7 kg/s, and is determined largely by the offset value for the mass rate controller. This is somewhat less than the initial mass flow rate setpoint B of about 1 kg/s, and after about 0.01 days the steam trap controller reset term starts to close the gap between the measured A and requested rate B.

The initial flash of superheated water occurs about half way up the production riser, at 59 minutes or about 0.04 days, causing a steep spike in the wellhead mass rate A. The mass rate controller responds to this with small but sharp closure of the choke position C.

Over the next ten minutes or so flashing proceeds from the initial location up to the wellhead, until a stable flow A is achieved. Events occurring in the riser proceed relatively smoothly for the next few hours with the mass rate A remaining relatively constant. This indicates that short term stabilization of the riser flow has been accomplished.

The wellhead pressure D, which was initially at 1.62 MPa, represents the reservoir pressure of 4.0 MPa, minus the hydrostatic pressure of the 240 meter water column initially present in the riser After the start of flow, this pressure D begins to rise gradually as lighter hot water fills the riser from below. The flashing process causes a sharp rise in wellhead pressure D as liquid is displaced by steam. This increase in pressure balances the reduction in hydrostatic head in the riser above the flash as the steam reduces the density of the contained fluid. At stable flow, the average hydrostatic gradient in the riser is about one half that for water at 1300 kPa/240 m, or about 5.4 kPa/m, due to the steam lift effect. This provides significant beneficial effects in restarting a dead well, or continued recoveries from underpressured operations.

The liner temperature differential E (Injection liner temperature—Production liner temperature), which was initialized at 5° C., does not measurably change until about 0.3 days of flow. This overall effect on the reservoir occurs long after the initial activity in the riser has stabilized. This reflects the huge thermal mass in the reservoir and the large quantity of water stored in the reservoir nearby the production liner, relative to the riser volume. After 0.3 days this differential E begins to increase, reflecting a cooling of the production liner relative to the injection liner. This means the flow rate is too low, and the steam trap controller responds by progressively increasing the mass flow rate setpoint B of the mass rate controller. The actual rate A tracks the setpoint B well, under the controlling action of the mass rate controller. The production choke is seen to open marginally but steadily C after 0.3 days to correct a decreasing production liner temperature.

At about 1.7 days the production liner temperature reverses trend sharply and begins to increase in temperature evidenced as a reduction in the liner temperature differential E. This represents the influx of condensate and steam from above the liner. After a few oscillations over about the next week, the system steadies out at stable flow A, with the correct amount of sub-cooling in the production well and an optimal recovery from the well.

The embodiments of the invention in which an exclusive property or privilege is claimed are defined as follows:

1. A method for stabilizing and controlling the upwards flow of hot fluid containing water in an upwardly rising conduit, to prevent unstable cyclic generation and collapse of two-phase flow, said conduit having a top fluid discharge, and said fluid entering the bottom of the conduit at a temperature greater than the saturation temperature of water at the conditions present at the top of the conduit, the method comprising:

providing a fluid production choke means located at the top of the conduit for adjusting the mass flow rate of the hot fluid issuing therefrom;

providing a mass flow detection means downstream of the production choke means to repetitively produce signals indicative of the mass flow rate of hot fluid flowing therethrough;

providing a first mass rate control means for receiving the mass flow detecting means signals and producing an output signal for adjusting the production choke means, thereby controlling the mass rate of fluid therethrough;

providing measurement means for repetitively producing process signals related to optimal production of the fluid;

providing a second controlling means for receiving the process signals and being cascaded to the first controlling means for modifying the output of the first controlling means when process signals indicate that the mass rate requires adjustment to achieve optimal production of fluid;

producing the hot fluid at a substantially constant mass rate over a short time interval using the first mass rate controller and production choke means, whereby two-phase flow is stabilized;

adjusting the mass rate of flow of the hot fluid, responsive to the process signals, over a time interval which is large relative to the short time interval of the first mass rate controller whereby the mass rate of fluid flow may be controlled at an optimal level.

2. The method as recited in claim 1 wherein the conduit comprises a wellbore, completed from the earth's surface, extending downwardly and opening into a subterranean reservoir, the fluid further comprising oils and included water.

3. The method as recited in claim 1 wherein the conduit comprises the production riser portion of a horizontal production well associated with a steam injection well of a Steam Assisted Gravity Drainage (SAGD) operation, and wherein the second controller means receives process signals indicative of the difference in temperature between the fluid at the bottom of the wellbore and the saturation temperature of water at the steam injection site, whereby the temperature difference is maintained to optimize production of hot fluid further oils and included water.

* * * * *